United States Patent [19]

Hayashi

[11] 4,164,088

[45] Aug. 14, 1979

[54] CARTRIDGE LOCKING DEVICE FOR AN AUTOMATIC GUN

[75] Inventor: Hisao Hayashi, Tokyo, Japan

[73] Assignee: Kabushiki Kaisha Kawaguchiya Hayashi Juho Kayaku-ten, Tokyo, Japan

[21] Appl. No.: 860,603

[22] Filed: Dec. 14, 1977

[30] Foreign Application Priority Data

Dec. 29, 1976 [JP] Japan ..... 51-159848

[51] Int. Cl.[2] ..... F41C 13/00

[52] U.S. Cl. ..... 42/17

[58] Field of Search ..... 42/17, 21

[56] References Cited

U.S. PATENT DOCUMENTS

| | | | |
|---|---|---|---|
| 659,507 | 10/1900 | Browning | 42/17 |
| 1,852,411 | 4/1932 | Henry | 42/17 |
| 2,278,589 | 4/1942 | Rutherford | 42/17 |
| 2,592,858 | 4/1952 | Clarkson | 42/17 |
| 2,604,713 | 7/1952 | Browning | 42/17 |
| 2,791,855 | 5/1957 | Simmons | 42/17 |
| 4,014,247 | 3/1977 | Tollinger | 42/17 |

*Primary Examiner*—Charles T. Jordan

*Attorney, Agent, or Firm*—Toren, McGeady and Stanger

[57] ABSTRACT

A cartridge/carrier locking device is used for an automatic gun loading arrangement of a type for removing a cartridge from a magazine onto a carrier by releasing it from a locked state for firing and for pushing it up into a barrel chamber by an upward sway of the carrier which takes place in response to the forward stroke of a breech block. A latch plate which is provided with a first claw part at its forward end for locking the cartridge and a second claw part at its rear end for locking the carrier, is pivotally attached to an inner wall of a receiver containing the automatic gun loading arrangement. The first and second claw parts serve, respectively, to lock the cartridge and the carrier as the claw parts alternately protrude into the inside of the receiver in a swaying fashion. A spring is arranged to push the second claw part of the latch plate to the inside of the receiver. A locking part is also arranged at the rear end of the latch plate and engages with the breech block, the carrier and the cartridge to restrict the swaying motion of the second claw part into the inside of the receiver so that the engagement is released allowing the second claw part to act and to release the first claw part from its action only when a retracting stroke of the breech block comes to exceed to preset value after the gun is fired.

1 Claim, 8 Drawing Figures

CARTRIDGE LOCKING DEVICE FOR AN AUTOMATIC GUN

BACKGROUND OF THE INVENTION

This invention relates to a cartridge locking device for an automatic gun.

An automatic gun is in general arranged to perform a series of automatic loading operations, after the gun has been fired, including extraction of an empty cartridge by a backward movement of a breech block which closes a breech face of a barrel; the return of a trigger device to a state of preparation for the next firing; then, concurrently, pushing up a cartridge removed from a magazine by an upward swaying action of a carrier; and sending the cartridge into a barrel chamber through a forward movement of the breech block. This series of actions (hereinafter will be called a rotating operation of an automatic gun) are accomplished in an extremely short period of time. After firing the gun, it is important for safety to have a timing arrangement that the next cartridge is pushed up or lifted by the carrier when the empty one has been completely ejected from a receiver by an extractor. In view of the importance of the above stated timing, heretofore the following arrangement has been employed in general: a cartridge lock normally attached to a receiver was used for locking a cartridge biased by a spring to be displaced from a magazine. The cartride was released from the lock and allowed to move onto the carrier when the breech block retracted. Then, also a cartridge locking latch was provided which locked the next cartridge and a carrier locking latch which restricted the upward sway of the carrier until the next cartridge was placed on the carrier with the breech block having been sufficiently retracted to complete the ejection of the empty cartridge.

However, such a conventional arrangement required many component parts and resulted in a complex construction. In addition to such drawbacks, it was necessary to have some means for releasing the carrier from the carrier locking latch for loading the magazine with cartridges, because the upward sway of the carrier was normally restricted. This also has been a drawback of the conventional arrangement.

In various studies conducted by the present inventor for elimination of such drawbacks of the conventional arrangement, the following points were noted:

(1) When a breech block has been retracted into a receiver, as caused by the spring force of a recoil spring located in a stock or the like, and begins to move forward to return to its initial position, the force of the forward movement of the breech block urges the carrier to sway upward. Such an upward swaying force on the carrier is exerted only by the forward movement of the breech block.

(2) Accordingly, the restriction on the upward swaying action of the carrier by a carrier lock is required only until a cartridge is removed from the magazine when the breech block urges the carrier to sway upward.

(3) As for the cartridge lock, since the barrel chamber must be loaded with the next cartridge shortly after the ejection of the emptied cartridge, the next cartridge must be released from the lock at a stage prior to such loading while the cartridge must always be kept locked with the exception of this stage.

(4) Heretofore, release of the upward sway of the carrier from the restriction has been effected by pushing the carrier latch with the bottom rim of the cartridge itself when it is moved onto the carrier.

The inventor thus has discovered that the best result can be obtained by releasing the cartridge lock either when the retraction of the breech block reaches about a maximum stroke or slightly earlier and, at the same time, by restricting the upward sway of the carrier due to the limiting force of the breech block until the cartridge is completely moved onto the carrier. This discovery has led to the present invention.

SUMMARY OF THE INVENTION

It is a general object of this invention to provide a cartridge/carrier locking device which eliminates the above stated drawbacks of the conventional devices by the use of a single latch plate which serves the combined purpose of locking a cartridge and a carrier.

It is another object of this invention to provide means for releasing, as desired, the above-mentioned automatic loading operation which is performed by the retracting action of the breech block. A shooter often wishes to change the cartridges loaded into a magazine and a chamber to cartridges of a different type better suited for the target object. It is desirable, in such a case, to enable the shooter to manually replace the cartridges in the chamber with such a different kind of cartridge while leaving the cartridges inside the magazine as they are. Such replacement is made possible in accordance with this invention by controlling the swaying or seesaw movement of a single latch plate.

It is still another object of this invention to provide an arrangement for locking the cartridges inside the magazine during a manual breech block retracting operation and unlocking the cartridges when firing is effected. In other words, the cartridge locking device of this invention not only permits manual loading of a gun with a different kind of cartridge as desired while retaining a normal kind of cartridges in the magazines, but also enables the automatic loading operation to work after one cartridge in the chamber is replaced with the different kind of cartridge. This latter facility is based on the fact that a firing recoil is extremely great. According to the results of experiments, when two engaging positions of a latch button within a hole provided in the side wall of a receiver are arranged to be shiftable from one position to the other with a simple stepped part provided at either the hole or the latch button, the firing recoil without fail causes the latch button to return to its normal position from a locked position through the action of a compression spring which is provided for preventing the latch button from rattling. However, further mechanical engaging features may be added to the latch button to ensure that there arises no problem with regard to such locking release, and, in such a case, a locking condition continues to prevent automatic loading of the next cartridge.

Other objects and aspects of the invention will become apparent from the following description of preferred embodiments of the invention with reference to the accompanying drawings.

BRIEF DESCRIPTION OF THE DRAWINGS

Preferred embodiment examples are illustrated in the accompanying drawings, wherein:

FIG. 6 is an enlarged sectional view showing a latch plate mounting part of an automatic gun. FIG. 7 is an enlarged sectional view showing a latch button mounting part. FIG. 8 is an illustration of an engaging state between the stepped part of the latch button and the inner side wall of a receiver as another embodiment example of the invention.

DESCRIPTION OF THE PREFERRED EMBODIMENTS

Figure 1:
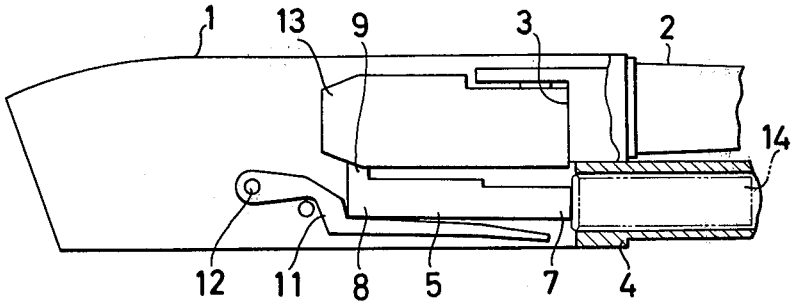
FIGS. 1, 3 and 5 are partly sectional illustrations of a receiver in an automatic gun, FIG. 1 showing the receiver in a state prior to firing, FIG. 3 showing it in a state of bringing out a cartridge and FIG. 5 showing it in a state of having a carrier in action.

Referring to FIG. 1 through FIG. 5, a reference numeral (1) indicates a receiver which houses a breech block, a trigger device, etc.; (2) indicates a barrel secured to the front part of the receiver (1); (3) indicates a breech face of the barrel (2); (4) indicates a magazine secured to the front part of the receiver (1) in parallel with the barrel (2); and (5) indicates a latch plate which is pivotally attached to the inner wall of the receiver (1) in a position approximately in the middle thereof and behind the magazine. The forward end and the rear end of the latch plate (5) are arranged to be capable of swaying on a pin (6) in such a way as to alternately come to protrude to the inside of the receiver (1). Reference numeral (7) indicates a first claw part formed at the forward end of the latch plate (5) for locking a catridge; (8) indicates a second claw part formed at the rear end of the latch plate 5 for locking a carrier; (9) indicates a third claw part which protrudes upward from the rear end of the latch plate (5) into sliding contact with a side face of a breech block; (10) indicates a spring which pushes the rear end of the latch plate (5) toward the inside of the receiver (1); and (11) indicates a carrier which is disposed inside the receiver (1) in a position behind the magazine (4) and is connected to an unillustrated trigger guard in a vertically movable manner through a pin (12) provided at the rear end thereof. The carrier (11) is connected to an unillustrated carrier dog which is capable of engaging with the breech block in such a way as to urge the carrier to sway upward when the breech block closes.

Figure 3:
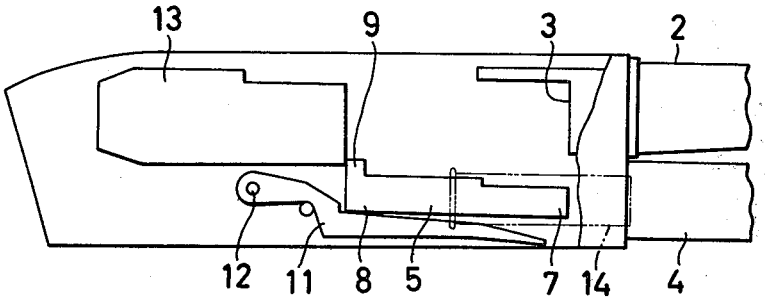

A reference numeral (13) indicates the breech block which is arranged to open and close inside the receiver (1) and is normally disposed to close the breech face (3) of the barrel (2) as shown in FIG. 1. When the gun is fired, an unillustrated gas operating device transmits a backward moving force to the breech block. This causes the breech block to retract as shown in FIG. 3 and then, a spring force of an unillustrated recoil spring causes the breech block to return to its initial position. Numerals (14) and (15) indicate cartridges, respectively.

Figure 2:
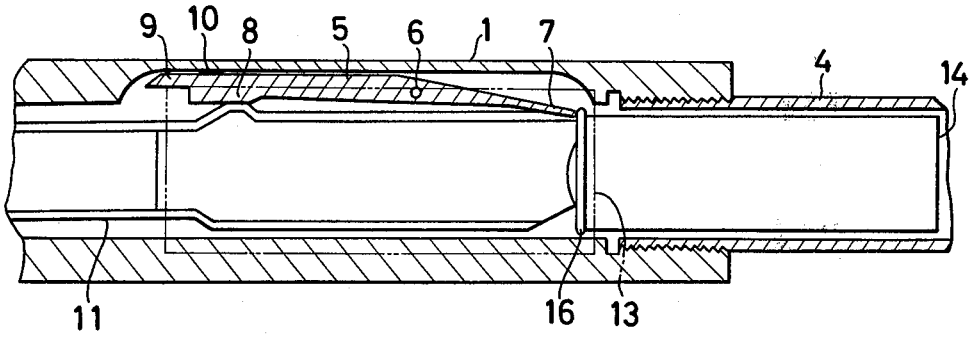
FIG. 2 is a partly cross sectional view showing the receiver of the automatic gun in a state as shown in FIG. 1.

The rotating operation of the above described automatic loading arrangement is accomplished in the following manner:

Under the condition prior to firing as illustrated in FIGS. 1 and 2, the breech block (13) is locked by the barrel (2) which closes the breech face (3). Then, the third claw part (9) of the latch plate (5) slidably engages a side face of the breech block while the first claw part (7) at the forward end of the latch plate thrusts forward to the inside of the receiver (1) against the pushing force of the spring (10). Accordingly, the first claw part (7) engages the bottom of the cartridge (14) and locks the cartridge (14) inside the magazine (4).

Figure 4:
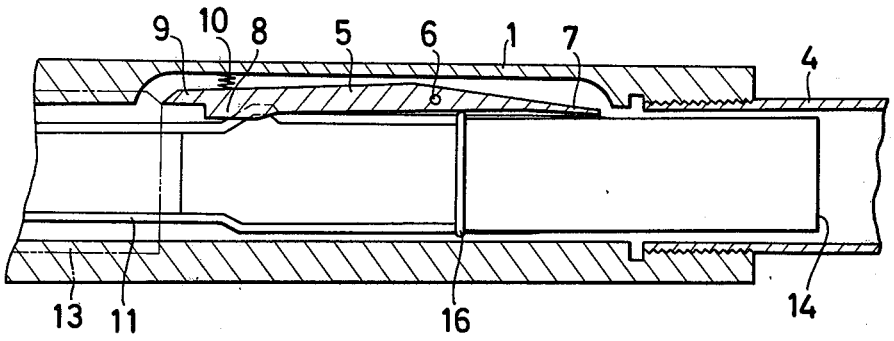
FIG. 4 is a partly cross sectional view showing the receiver in a state as shown in FIG. 3.

When the gun is fired, the breech block (13) retracts and when it reaches about a maximum retracted position, the third claw part (9) of the latch plate (5) disengages from the breech block (13) as shown in FIGS. 3 and 4. Then, the pushing force of the spring (10) causes the rear end of the latch plate (5) to sway to the inside of the receiver (1) and restrict the upward swaying motion of the carrier (11) with the second claw part (8). On the other hand, the above stated locking of the cartridge is released as the forward end of the latch plate (5) sways to the inner wall of the receiver (1). This condition continues until the cartridge (14) is sufficiently displaced out of the magazine 4 onto the carrier (11) by the spring (unillustrated) provided inside the magazine. Meanwhile, the upward sway of the carrier (11) does not take place even if the breech block commences its forward movement under such a condition.

Figure 5:
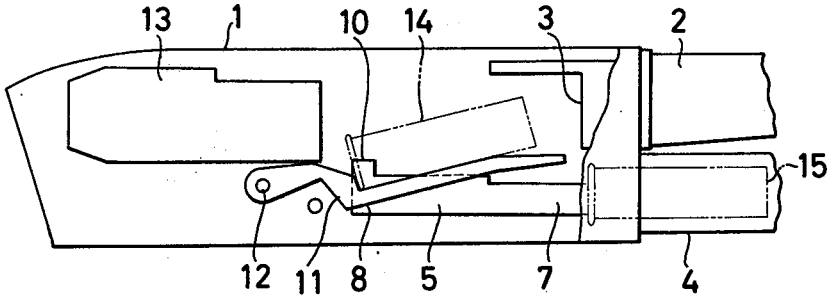

When the cartridge (14) extends sufficiently brought out of the magazine onto the carrier (11), the bottom rim of the cartridge (14) pushes the second claw part of the latch plate (5) against the force of the spring (10) to release the carrier lock. Accordingly, the upward urging force immediately causes the carrier (11) to sway upward and the cartridge (14) is pushed up thereby to the rear of the barrel (2). At the same time, the side face of the carrier (11) pushes the second claw part (8) of the latch plate (5) as shown in FIG. 5. The cartridge (14) is then placed into the chamber of the barrel (2) by the forward movement of the breech block (13), which thus again engages the third claw part (9) of the latch plate (5). Through such processes, the rear end of the latch plate (5) is continuously pushed by the rim of the cartridge (14), the side face of the carrier and the side face of the breech block (13) one after another against the force of the spring (10). This continuous pushing causes the first claw part (7) located at the forward end of the latch plate (5) to continuously protrude toward the inside of the receiver (1) and the next cartridge (15) is locked thereby inside the magazine (4) as shown in FIG. 5.

As described in the foregoing, in the cartridge/carrier locking device of the present invention, a single latch plate, the forward and rear ends of which are arranged to alternately sway within the receiver, is connected to the inner wall of the receiver; a spring force is applied to the rear end of the latch plate to urge it toward the inside of the receiver while the swaying protrusion of the rear end, urged by the spring force, is arranged to be hindered by the breech block, the carrier and the cartridge; the rear end of the latch plate is released from such hindrance only when the backward movement of the breech block resulting from firing reaches about a maximum stroke; and, normally, catridge locking is effected with the forward end of the latch plate protruding to the inside of the receiver while the rear end of the latch plate leaves the carrier unlocked. The condition is reversed only when the backward movement of the breech block reaches about the maximum stroke as mentioned in the foregoing. In this manner, the conventional cartridge locking and carrier locking devices can be satisfactorily replaced with the single latch plate. The invented device thus permits simplification of construction and reduction in the number of required parts.

While a preferred embodiment has been described, this invention is not limited to such and various embodiments may be made, for example, including the following:

In locking the rear end of the latch plate to prevent it from swaying toward the inside of the receiver, the position at which such locking is effected by the breech block is spaced from the position at which the latch plate locks the bottom rim of the cartridge so that when the latch plate is locked by the breech block, the rear end of the latch plate is allowed to protrude to the inside of the receiver to a certain extent to restrict the upward sway of the carrier in an auxiliary manner. With such arrangement, abnormal movement of the carrier due to vibration and the like can be effectively prevented.

Figure 6:
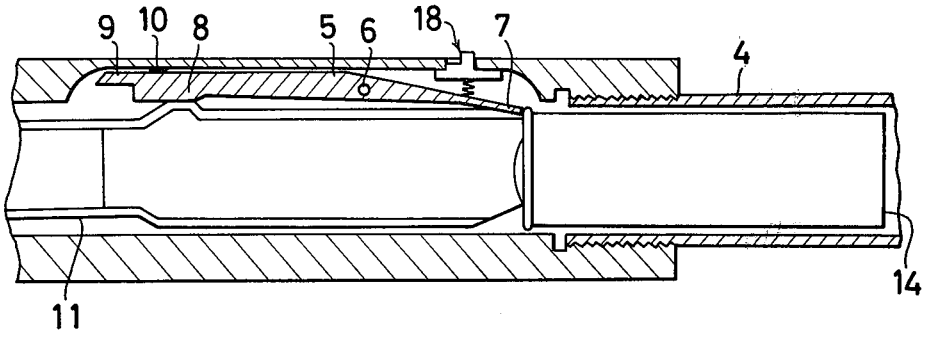
FIGS. 6–8 show other embodiment examples.
Figure 7:
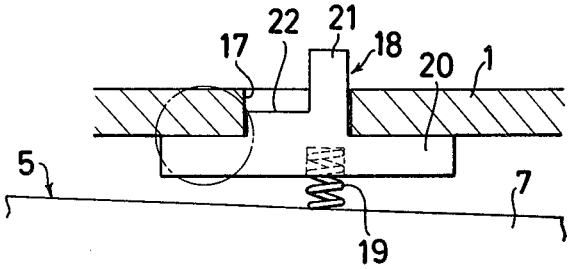
Figure 8:
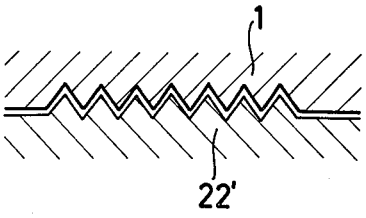

FIG. 6 through FIG. 8 illustrate further embodiments which are characterized by the provision of the following arrangement:

A reference numeral (17) indicates a hole extending through a side wall of the receiver (1) with a latch button (18) which has a stepped protrusion arranged to engage with the hole (17); and (19) indicates an antirattling compression spring provided between the latch button (18) and the first claw part (7) of the latch plate. The latch button (18) comprises a base part (20) which prevents the latch button (18) from displacement through the perforated hole (17) of the side wall of the receiver (1), a protrusion (21) which is movable within the hole (17) in the axial direction of the hole and a stepped part (22) which forms a part of the protrusion (21). The engagement between the latch button (18) and the hole (17) provided in the side wall of the receiver (1) is manually shiftable between two engaging positions, the inner side face of the side wall of the receiver (1) engaging with the base part (20) in one position and with the stepped part (22) of the latch button (18) in the other.

With the above mentioned arrangement, the gun operates as follows: when the inner side face of the side wall of the receiver (1) engages the base part (20) of the latch button (18), i.e. under an unlocked condition, the single latch plate (5) performs the normal action of bringing out the next cartridge through its seesaw movement which takes place at the maximum breech block retraction stroke.

When the latch button (18) is manually pushed to the inside of the receiver (1) causing the stepped part (22) to engage the inner side face of the side wall of the receiver (1), i.e. to bring about a locked condition, the latch button (18) comes into contact with the first claw part 7 of the latch plate which has swayed into the receiver (1). Because of this, the seesaw movement of the latch plate (5) is prevented by the latch button (18) even when the breech block (13) makes the maximum retraction stroke. However, in cases where the engaging part of the inner face of the side wall of the receiver (1) and that of the stepped part (22) of the latch button (18) are flat having a relatively low frictional resistance as illustrated in the drawing, a recoil brought about by firing the gun causes displacement of the latch button (18) in the axial direction and then the compression spring (19) causes the latch button to come back into its normal position. It has been ascertained through experiments that, in accordance with this embodiment of the invention, such unlocking takes place without fail. Where such unlocking by a firing recoil is not desired, the displacement of the latch button (18) must be prevented through, for example, a saw-tooth like engagement between a stepped part (22') of the latch button (18) and the inner side face of the side wall of the receiver (1) as shown in FIG. 8.

With the cartridge locking device which uses the single latch plate further improved in accordance with the above described embodiment example of the invention, the gun can be released from the automatic cartridge loading function as desired. The arrangement required for such release is very simple. Besides, the cartridge locking action can be divided into continuous and temporary actions as desired. The invented arrangement is therefore highly advantageous for practical applications.

What is claimed is:

1. In an automatic gun loading operation including a receiver, a carrier pivotally mounted within said receiver, a magazine secured to said receiver for holding cartridges, a barrel chamber attached to said receiver, a breech block located within said receiver and movably displaceable forwardly and rearwardly therein relative to said barrel chamber, and arranged for removing a cartridge from the magazine into said carrier by releasing it from a locked state for firing the gun and for placing the cartridge into said barrel chamber by the upward sway of said carrier which takes place in response to the forward stroke of said breech block, the improvement comprising a cartridge/carrier locking device including a latch plate located within said receiver and having a first claw part at its forward end closer to said barrel chamber for locking the cartridge and a second claw part at its rear end more remote from said barrel chamber for locking said carrier, said latch plate pivotally attached to the inner wall of said receiver, said first and second claw parts serve, respectively, to lock the cartridge and the carrier as they alternately protrude into the interior of said receiver in a swaying fashion, a spring within said receiver arranged to push said second claw part of said latch plate into the interior of said receiver, a locking part arranged at the rear end of said latch plate to engage said breech block, carrier and cartridge to restrict the swaying motion of said second claw part protruding into the interior of the receiver so that the engagement is released to allow the second claw part to act and to release the first claw part from its action only when a retracting stroke of said breech block exceeds a preset value after the gun is fired, said receiver has a hole therethrough from the exterior to the interior thereof aligned with the first claw part of said latch plate, a latch button having a first engaging face and a second engaging face formed in two stages in the axial direction of the hole for engagement with the inner wall of said receiver with said second engaging face located closer to the exterior of said receiver than said first engaging face, and an antirattling spring biasing said latch button toward the outside of said receiver, the swaying movement of said first claw part of said latch plate being mechanically locked when said latch button is pushed inwardly against the force of said antirattling spring and causing said second engaging face to engage with the inner wall of said receiver.

* * * * *